US005413677A

United States Patent [19]

Collins

[11] Patent Number: 5,413,677

[45] Date of Patent: May 9, 1995

[54] METHOD FOR PRODUCING CHEMICAL PULP FROM HARDWOOD CHIPS

[75] Inventor: Robert H. Collins, Saratoga, N.Y.

[73] Assignee: Kamyr, Inc., Glens Falls, N.Y.

[21] Appl. No.: 41,572

[22] Filed: Apr. 5, 1993

[51] Int. Cl.[6] ..... D21C 7/10; D21C 7/14

[52] U.S. Cl. ..... 162/42; 162/17; 162/19; 162/39; 162/242; 162/249

[58] Field of Search ..... 162/19, 17, 29, 39, 162/42, 242, 249

[56] References Cited

U.S. PATENT DOCUMENTS

| | | | |
|---|---|---|---|
| 3,849,247 | 11/1974 | Richter | 162/246 |
| 3,954,553 | 5/1976 | Dillard et al. | 162/86 |
| 4,668,340 | 5/1987 | Sherman | 162/16 |

FOREIGN PATENT DOCUMENTS

93/04232 3/1993 WIPO .

OTHER PUBLICATIONS

C. A. Backlund, "Extended Delignification . . . Cont. Digester", TAPPI Journal, Nov., 1984; pp. 62–65.

Rydholm, Sven "Continuous Pulping Processes", TAPPI, 1970, pp. 121–157.

Blom et al., "Development of the Alva Prehydrolysis Process", 1981 Pulping Conference, 409–416.

Kortelainen et al., "Experiences w/extended Delig. . . . ", Tappi Journal, Nov. 1985, pp. 70–74.

McDonald et al., "The Pulping of Wood", 2nd Edition, 1969, pp. 422–427.

Tappi Proceedings—1981 Pulping Conference—Development of the Alva Prehydrolysis Process—Part Two: Mill Scale Application Blom, Nevalainen & Arhippainen, pp. 409–416.

Kamyr AB Kraft Prehydrolysis drawing figure; Feb. 1, 1982.

*Primary Examiner*—W. Gary Jones

*Assistant Examiner*—Dean T. Nguyen

*Attorney, Agent, or Firm*—Nixon & Vanderhye

[57] ABSTRACT

Chemical pulp is produced from hardwood chips in a simplified manner utilizing a continuous digester. An inverted top separator is provided in the circulatory loop between the high pressure feeder and the top of the continuous digester for thermally isolating circulations on either side of the inverted top separator. Relatively cool liquor circulates between the inverted top separator and high pressure feeder, at a temperature such that it will not flash into steam in a high pressure feeder, while in the circulatory loop from the high pressure feeder to the digester the chips are in cooking liquor at cooking temperature. Since hardwood chips require less cooking than softwood chips, a single heating source for heating the liquor to cooking temperature is provided, external of the digester, and a conventional cooking circulation loop within the digester is not required.

16 Claims, 3 Drawing Sheets

METHOD FOR PRODUCING CHEMICAL PULP FROM HARDWOOD CHIPS

BACKGROUND AND SUMMARY OF THE INVENTION

Conventional continuous digesters utilize a feed system, including a high pressure feeder, for feeding a slurry of chips in cooking liquor either directly to the top of a continuous digester, or through an impregnation vessel and then to the top of the digester. Most designs of conventional Kamyr ® continuous digesters are provided to allow the cooking of softwood chips, the softwood chips containing substantial amounts of lignin. Because substantial cooking of softwood chips is necessary, the continuous digester includes a cooking loop circulation, as well as other circulations.

Hardwood chips contain less lignin than softwood chips and thus it is easier to cook them, requiring less time at temperature to dissolve and remove the lignin. According to the present invention, an apparatus and method are provided which specifically take into account the fact that hardwood chips are easier to cook, which has a number of advantages over conventional systems. According to the invention a separate impregnation vessel is unnecessary, the digester cooking circulation with associated pumps, heaters, and piping are eliminated, and a more uniform heating of the chip mass and subsequent better quality pulp may be obtained.

According to one aspect of the present invention, a method of producing chemical pulp from hardwood chips utilizing a vertical digester having a top and a bottom, and a high pressure feeder, is provided. The method comprises the steps of continuously and substantially sequentially: (a) Steaming the hardwood chips. (b) Entraining the hardwood chips in liquor at a relatively cool temperature, so that the liquor will not significantly flash into steam in a high pressure feeder. (c) Feeding the chips entrained in relatively cool liquor under high pressure toward the top of the digester using the high pressure feeder. (d) Externally of the digester, replacing the relatively cool liquor entraining the chips with relatively hot cooking liquor, at cooking temperature, and recirculating the replaced relatively cool liquor to the high pressure feeder, so as to significantly thermally isolate the high pressure feeder from the digester. (e) Feeding the hardwood chips entrained in cooking temperature cooking liquor to the top of the digester. (f) At the top of the digester, separating some liquor from the chips. (g) Recirculating and reheating the liquor separated from the chips in step (f), to provide a significant part of the cooking liquor in step (d). And, (h) cooking the chips in the digester in a cooking zone, to ultimately produce chemical hardwood pulp, and removing the hardwood pulp from the bottom of the digester.

Steps (b) and (c) are practiced with cooking liquor at a temperature of roughly 240° F., and steps (d) and (g) are practiced with cooking liquor at roughly 290° F., for kraft cooking. Cooking liquor is added to the liquor separated during the practice of step (f), prior to the reheating in step (g). Step (h) is preferably practiced without the addition of heat during the cooking zone, utilizing only heat provided from the cooking liquor added in step (d). There is also typically the further step of, after step (h), further cooking the chips in a modified cooking zone, and washing the chips in the digester, and withdrawing, heating, and recirculating liquors in the modified cooking and washing zones. Step (d) is typically practiced utilizing an inverted top separator.

The invention also comprises apparatus for cooking hardwood chips. The apparatus comprises the following components: A steaming vessel. A high pressure feeder. A chips chute operatively connecting the high pressure feeder to the steaming vessel. A vertical digester having a top and a bottom. First separating means, external of the digester, for replacing a first liquor entraining chips with a second liquor, the separating means disposed between the high pressure feeder and the top of the digester. Second separating means, internal of the digester at the top thereof, for withdrawing some of the liquor entraining chips introduced into the top of the digester. First recirculating means for recirculating the first liquor from the first separating means to the high pressure feeder. Second recirculating means for recirculating liquor separated by the second separating means to the first separating means, the second recirculating means including a heater. And, pulp withdrawal means for withdrawing pulp from the bottom of the digester.

The first separating means preferably comprises an inverted top separator, while the second separation means comprises a continuous conical screen disposed in the interior of the digester at the top thereof. The vertical digester has a cooking zone, and preferably the digester is devoid of a recirculation loop in the cooking zone, although recirculatory loops are provided associated with modified cooking zones and wash zones further down in the digester, if present.

It is the primary object of the present invention to provide a method and apparatus for simply yet effectively cooking hardwood chips to produce chemical pulp. This and other objects of the invention will become clear from an inspection of the detailed description of the invention and from the appended claims.

DETAILED DESCRIPTION OF THE DRAWINGS

Figure 1:
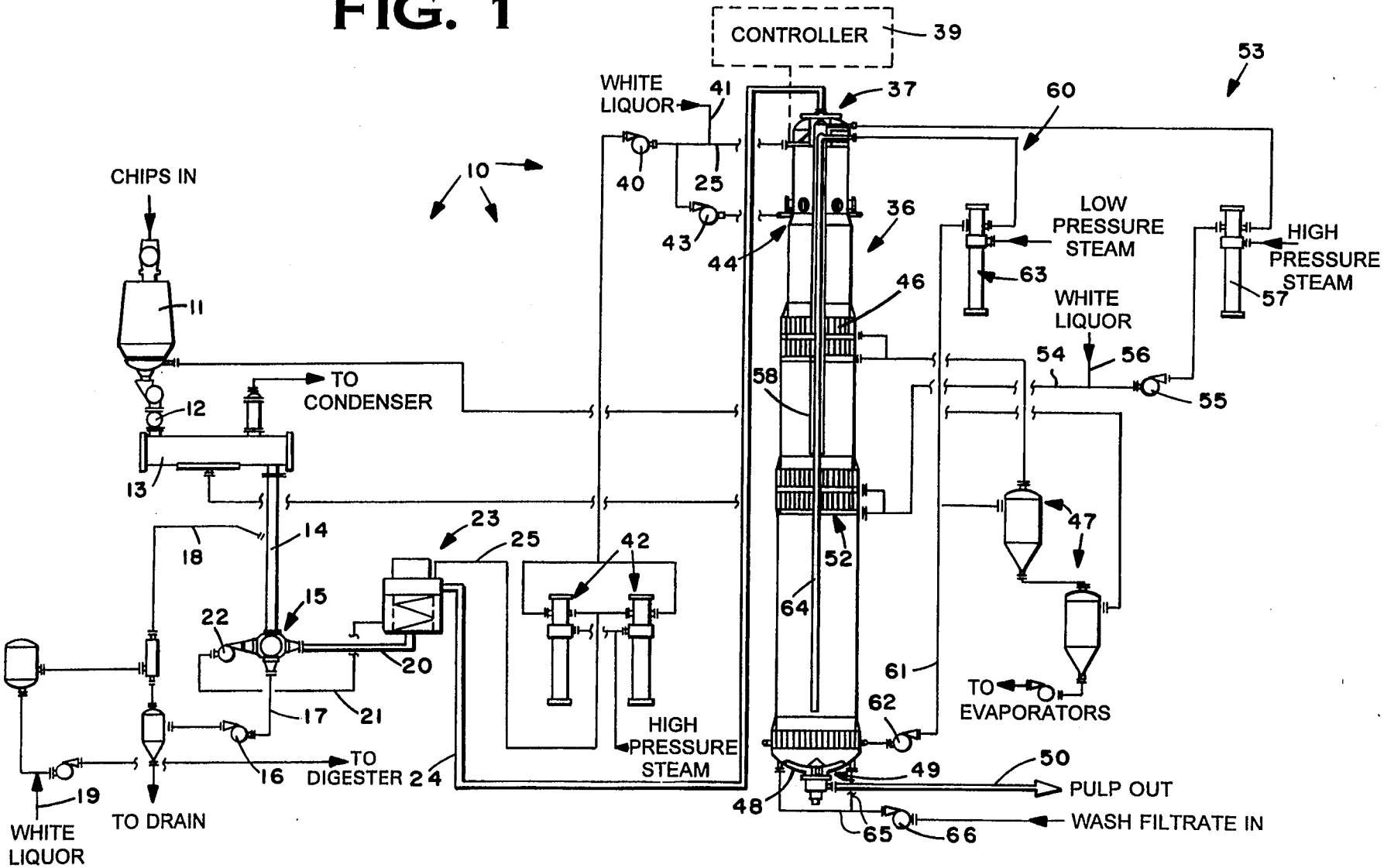
FIG. 1 is a schematic view of exemplary apparatus according to the present invention.

Apparatus indicated generally by reference numeral 10 in FIG. 1 includes a conventional chip bin 11, low pressure feeder 12, horizontal steaming vessel 13, high pressure feeder 15, and chip chute 14 connecting the outlet from the steaming vessel 13 to the low pressure inlet to the high pressure feeder 15. A low pressure chip chute pump 16, connected via line 17 to the low pressure outlet from the high pressure feeder 15, recirculates liquor (e.g. cooking liquor) removed in the low pressure circulation of the high pressure feeder 15, passing through conventional devices (such as a sand separator, in-line drainer, and the like) to the line 18 which returns treatment liquor to the chip chute 14, and establishes a level in the chip chute 14. Kraft white liquor, or other cooking liquor depending upon the particular chemical process being used, is typically added in line 19.

Extending from the high pressure outlet of the high pressure feeder 15 is a line 20, while a high pressure return line 21 connected up to the high pressure pump 22 is also provided. The lines 20, 21 are connected to an inverted top separator, which is a, per se, conventional piece of equipment which typically is mounted at the top of a treatment vessel, but can also stand alone, as does the structure 23. Extending from the inverted top separator 23 is an outlet line 24, while an inlet line 25 returns liquor to the inverted top separator 23. The lines and pump 20–22 provide a first recirculatory means (loop), while the lines 24 and 25, with associated components to be hereafter described, comprise a second recirculating means (loop).

Figure 2:
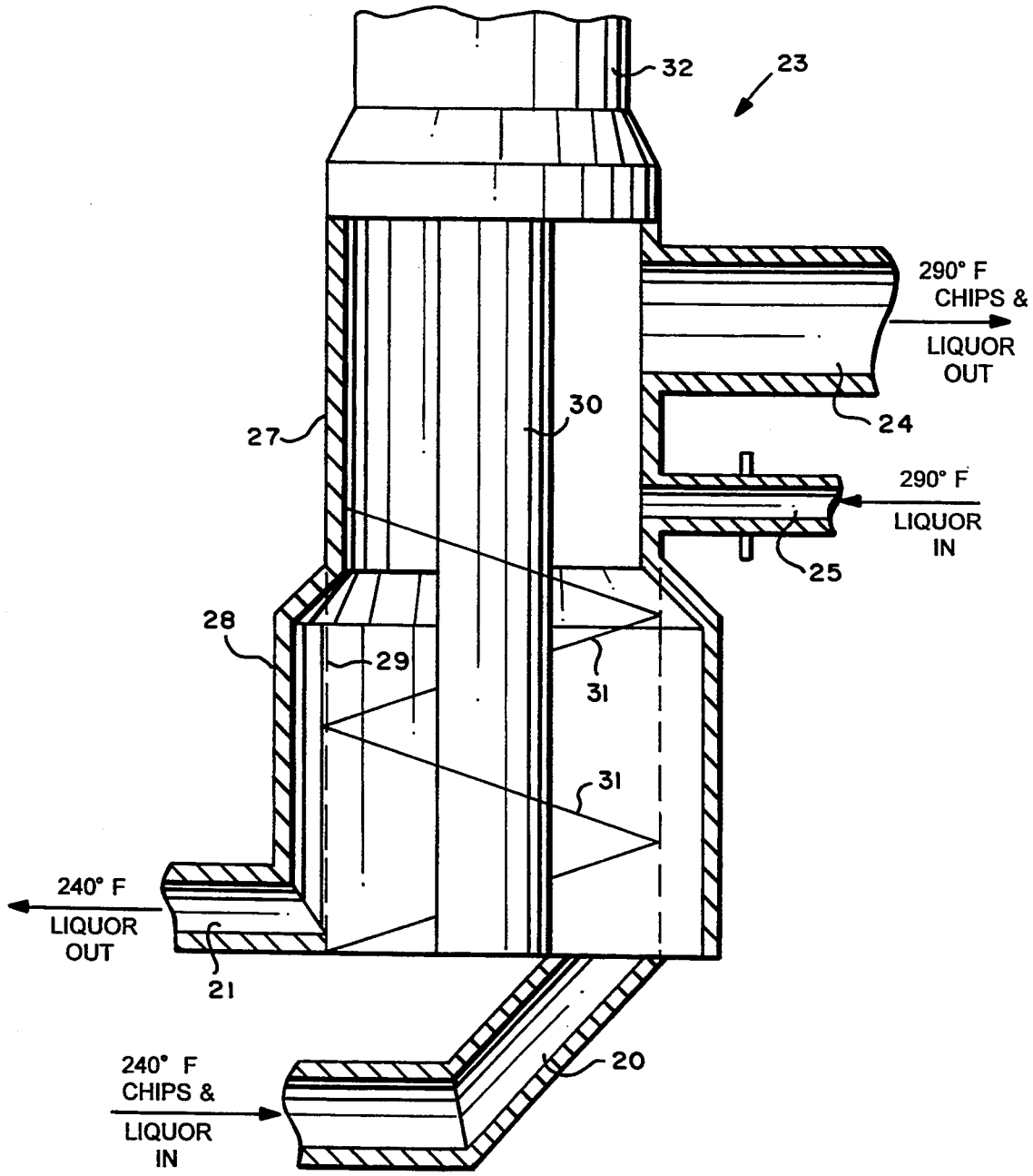
FIG. 2 is a detail schematic side cross-sectional view of an exemplary inverted top separator used in the apparatus of FIG. 1.

The inverted top separator 23 is shown in more detail in FIG. 2. It includes a main housing 27, with an enlarged bottom portion 28 having an annular screen 29 mounted therein. A shaft 30 extends through the center of the housing 27, and has a screw conveyor flight or flights 31 thereon, the shaft 30 is rotated about a substantially vertical axis by the conventional drive motor and gear reducers 32.

In use of the inverted top separator 23 (comprising a first liquid/solids separator) according to the invention, hardwood chips in cooking liquor at a temperature of roughly about 240° F. (for a kraft cook) are fed in line 20 to the bottom of the top separator 23. The chips pass upwardly in the device 23, assisted by the screw conveyor flights 31, while the majority of the liquor associated with the chips passes through the openings in the annular screen 29, and returns in line 21 to the high pressure feeder 15.

In the top portion of the housing 27 of the device 23, above the annular screen 29, cooking liquor at cooking temperature is introduced to entrain the chips, the cooking liquor at cooking temperature replacing the relatively low temperature liquor in the slurry that fed the chips to the device 23. For example, for a kraft cook, kraft white liquor at a temperature of about 290° F. is introduced in line 25, and the entrained chips and liquor of the slurry exit the housing 27 in line 24, and are fed to the top 37 of a digester 36.

Figure 3:
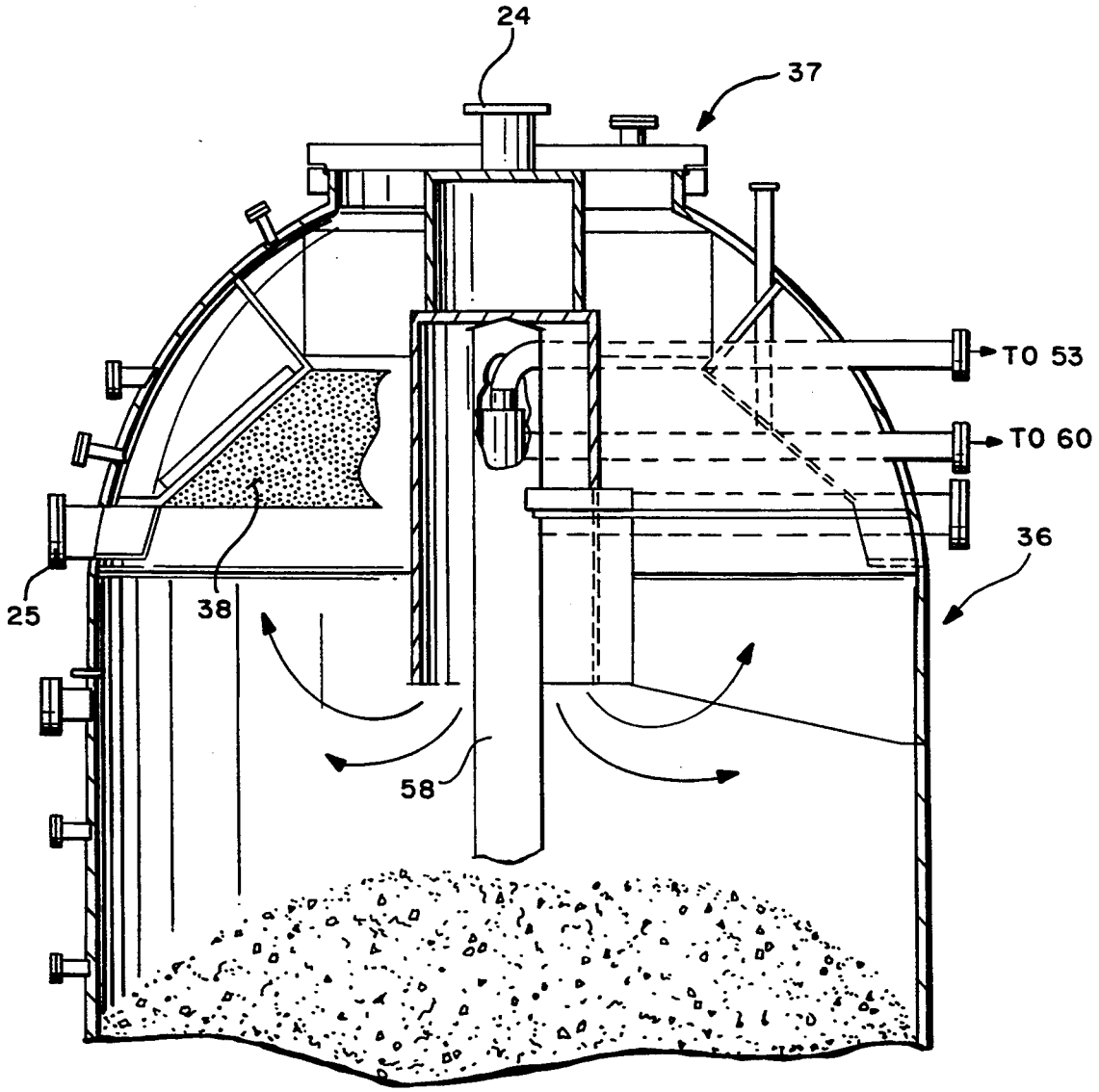
FIG. 3 is a detail cross-sectional view of the top of the digester of FIG. 1.

At the top 37 of the vertical continuous digester 36, a second liquor/chips separating means is provided, preferably in the form of continuous conical screen 38 (see FIG. 3). Alternatively, a plurality of circumferentially spaced screens may be provided on the interior thereof, and a controller 39 (see FIG. 1) or like means may be provided for periodically switching the screen or screens that are operable, while at least one screen remains inoperable.

The interior of screen 38 (FIG. 3) is connected to a pump 40 (FIG. 1) via line 25, and white liquor can be added to the line 25 as indicated by conduit 41. Another withdrawal loop can be provided by the pump 43 and associated screen arrangement 44, the line 25 ultimately being connected to bottom circulation heaters 42. Typically only one of the heaters 42 is operable at one time, the other providing a spare, and high pressure steam is utilized to indirectly heat the liquor flowing in the line 25 so that it is at or above cooking temperature (that is about 290° F. for a kraft cook).

The digester 36 need not have any cooking circulatory loop. That is, in the zone between the top 37 and the extraction screens 46, no recirculatory loop—or associated pumps and heaters—need be provided.

The extraction screens 46 remove black liquor from the digester 36, passing it to flash tanks 47 as is conventional. Produced pulp is withdrawn from the bottom 48 of the digester 36, such as by utilizing a conventional outlet device 49, the pulp being discharged in line 50.

If the digester 36 utilizes extended cooking techniques, such as MCC® or EMCC® cooking, then circulatory loops may be provided associated therewith. For example, the digester 36 illustrated in FIG. 1 is an MCC® digester, so that the screens 52 withdraw liquor, which is passed into a circulatory loop 53, including line 4 and heater 57, and reintroduced into pipe 58.

A washing loop can also be provided, a wash zone being provided below the MCC® screens 52. The wash loop is indicated generally by reference numeral 60, and includes the line 61, pump 62, heater 63, and reintroduction pipe 64. Wash liquor is introduced in line 5, being pumped by the pump 66.

Utilizing the apparatus 10, the following method steps may be practiced (continuously and substantially sequentially):

Steaming hardwood chips, in the bin 11 and/or steaming vessel 13.

Entraining the hardwood chips in liquor (such as kraft cooking liquor) at a relatively cool temperature so that the liquor will not significantly flash into steam in the high pressure feeder 15, the entraining primarily taking place in the chips chute 14.

Feeding the chips entrained in relatively cool liquor under high pressure toward the top of a digester 36 using the high pressure feeder 15.

Externally of the digester (e.g. in top separator 23) replacing the relatively cool liquor entraining the chips with relatively hot cooking liquor (e.g. kraft white liquor), at cooking temperature (e.g. roughly 290° F.), and recirculating the replaced relatively cool liquor to the high pressure feeder 15 (in line 21), so as to significantly thermally isolate the high pressure feeder 15 from the digester 36.

Feeding the hardwood chips entrained in cooking liquor at cooking temperature to the top of the digester 36 (in line 24).

At the top 37 of the digester 36, separating some liquor from chips.

Recirculating and reheating the liquor separated from the chips at the top of the digester, to provide a significant part of the cooking liquor that replaces the relatively cool liquor (in the top separator 23), as by utilizing the recirculatory line 25, pump 40, and heaters 42. And, cooking the chips in the digester 36 in a cooking zone (between the top 37 and extraction screens 46), to ultimately produce chemical hardwood pulp, and removing the hardwood pulp from the bottom of the digester 36 (in line 50).

It will thus be seen that according to the present invention a method and apparatus for effectively and simply cooking hardwood chips has been provided. While the invention has been herein shown and described in what is presently conceived to be the most practical and preferred embodiment thereof many modifications may be made thereof within the scope of the invention, which scope is to be accorded the broadest interpretation of the appended claims so as to encompass all equivalent apparatus and methods.

What is claimed is:

1. A method of producing chemical pulp from hardwood chips, using a vertical digester having a top and a bottom and a cooking zone, and a high pressure feeder, comprising the steps of continuously and substantially sequentially:

(a) steaming the hardwood chips;

(b) entraining the hardwood chips in alkaline cooking liquor at a relatively cool temperature, so that the liquor will not significantly flash into steam in a high pressure feeder;

(c) feeding the chips entrained in relatively cool liquor under high pressure to a point external of the top of the digester using the high pressure feeder;

(d) at said point external of the digester, replacing the relatively cool liquor entraining the chips with relatively hot cooking liquor, at cooking temperature, and recirculating the replaced relatively cool liquor to the high pressure feeder, so as to thermally isolate the high pressure feeder from the digester;

(e) feeding the hardwood chips entrained in cooking liquor at cooking temperature directly to the cooking zone at the top of the digester;

(f) at the top of the digester, separating some liquor from the chips;

(g) recirculating and reheating the liquor separated from the chips in step (f), to provide a significant part of the cooking liquor in step (d); and (h) cooking the chips in the digester in a cooking zone, to ultimately produce chemical hardwood pulp, and removing the hardwood pulp from the bottom of the digester.

2. A method as recited in claim 1 wherein step wherein steps (b) and (c) are practiced with cooking liquor at a temperature of roughly 240° F., and wherein steps (d) and (g) are practiced with cooking liquor at roughly 290° F.

3. A method as recited in claim 2 comprising the further step of adding cooking liquor to the liquor separated during the practice of step (f), prior to reheating in step (g).

4. A method as recited in claim 3 wherein step (h) is practiced without the addition of heat during the cooking zone, utilizing only the heat provided from the cooking liquor added in step (d).

5. A method as recited in claim 4 comprising the further steps of, after step (h): further cooking the chips in a modified cooking zone; washing the chips in a washing zone in the digester; and withdrawing, heating, and recirculating liquors in the modified cooking and washing zones.

6. A method as recited in claim 5 wherein step (d) is practiced utilizing an inverted top separator.

7. A method as recited in claim 1 comprising the further step of adding cooking liquor to the liquor separated during the practice of step (f), prior to reheating in step (g).

8. A method as recited in claim 1 wherein step (h) is practiced without the addition of heat during the cooking zone, utilizing only the heat provided from the cooking liquor added in step (d).

9. A method as recited in claim 1 comprising the further steps of, after step (h): further cooking the chips in a modified cooking zone; washing the chips in a washing zone in the digester; and withdrawing, heating, and recirculating liquors in the modified cooking and washing zones.

10. A method as recited in claim 1 wherein step (d) is practiced utilizing an inverted top separator.

11. A method as recited in claim 1 wherein the cooking liquor is kraft cooking liquor, and wherein steps (a)–(h) are practiced to produce kraft pulp.

12. A method as recited in claim 11 wherein steps (b) and (c) are practiced with cooking liquor at a temperature of roughly 240° F., and wherein steps (d) and (g) are practiced with cooking liquor at roughly 290° F.

13. A method as recited in claim 12 comprising the further step of adding cooking liquor to the liquor separated during the practice of step (f), prior to reheating in step (g).

14. A method as recited in claim 13 wherein step (h) is practiced without the addition of heat during the cooking zone, utilizing only the heat provided from the cooking liquor added in step (d).

15. A method as recited in claim 14 comprising the further steps of, after step (h): further cooking the chips in a modified cooking zone; washing the chips in a washing zone in the digester; and withdrawing, heating, and recirculating liquors in the modified cooking and washing zones.

16. A method as recited in claim 15 wherein step (d) is practiced utilizing an inverted top separator.

* * * * *